United States Patent [19]

Hartkorn

[11] Patent Number: 4,637,085

[45] Date of Patent: Jan. 20, 1987

[54] JOINT SPANNING CONSTRUCTION FOR BRIDGES OR SIMILAR STRUCTURES

[76] Inventor: Alfred Hartkorn, Kolpingstrasse 25, D-8068 Pfaffenhofen, Fed. Rep. of Germany

[21] Appl. No.: 727,361

[22] Filed: Apr. 25, 1985

[30] Foreign Application Priority Data

Apr. 30, 1984 [DE] Fed. Rep. of Germany ..... 34160809

[51] Int. Cl.[4] ..... E01D 19/06; E01C 11/02

[52] U.S. Cl. ..... 14/16.5; 404/64; 404/66; 404/68

[58] Field of Search ..... 14/16.5; 404/64–69, 404/48, 49, 47; 52/396

[56] References Cited

U.S. PATENT DOCUMENTS

| | | | |
|---|---|---|---|
| 2,042,408 | 5/1936 | Lawrence | 404/69 |
| 3,324,774 | 6/1967 | Boschi | 404/47 |
| 3,880,539 | 4/1975 | Brown | 14/16.5 X |
| 4,007,994 | 2/1977 | Brown | 14/16.5 X |
| 4,282,620 | 8/1981 | Hartkorn | 14/16.5 |

FOREIGN PATENT DOCUMENTS

| | | | |
|---|---|---|---|
| 2093885 | 9/1982 | United Kingdom | 404/65 |

*Primary Examiner*—James A. Leppink
*Assistant Examiner*—Matthew Smith
*Attorney, Agent, or Firm*—Paul L. Sjoquist

[57] ABSTRACT

A joint spanning construction for bridges has a sealing body flush with the top edge of the road surface and comprising beading made of resilient rubber material inserted into recesses of open-topped sills. The beading is secured against lifting out by retainer bodies of circular cross-section which are fitted half in the walls of the sill recesses and half in the beading. The sills respectively feature webs, which have approximately parallel sides and which are directed towards the road surface so as to extend into the beading. The sections of beading separated by the webs feature concave recesses on their sides opposite the respective webs, and in each case the outer one of such recesses is engaged by the retainer body concerned.

7 Claims, 2 Drawing Figures

JOINT SPANNING CONSTRUCTION FOR BRIDGES OR SIMILAR STRUCTURES

BACKGROUND OF THE INVENTION

1. Field of the Invention

The invention relates to a joint spanning construction for bridges or similar structures of the type in which sealing bodies made of resilient rubber material are inserted from above, in the form of beading, so as to be flush with the surface of the road in recesses of sills or, should the occasion arise, in movable open-topped intermediate girders, and secured against lifting out by retainer bodies which are basically of round cross-section and fit partly in a wall of the associated recess and partly in the beading.

2. Description of the Prior Art

A joint spanning construction of this type is disclosed in German Patent Specification AS No. 28 34 361. The sills or intermediate girders are with this construction of fork-shaped design and are completely covered by the sealing bodies in each case. In order to ensure that the round retainer bodies can also be secured in their effective position during the insertion of the beading, notches are provided in the sealing body above the recesses in the beading so that the free edges of the sealing body where applicable can be turned back.

The fork-shaped design of the sills provides a relatively thick section in height, which is further increased by the section of the sealing body lying on the ends of the free flanges. The sills of the prior art are still unsuitable, therefore, for installation in existing structures, because the relatively thick section requires extensive chiseling or chipping out of the edges of the concrete or asphalt cement, which is not only expensive and time consuming but can lead to structural damage as well.

Relatively flat sealing bodies are also disclosed in German Patent Specification OS No. 25 16 427, which relates to to a construction which comprises U-shaped, bent-up brackets surrounding the beading, but these brackets are not designed so that they can be used as bearers on the structure.

SUMMARY OF THE INVENTION

The object of the invention is to provide the facility of being able to install joint spanning constructions of the foregoing type with the least possible expense, even for retro-installation in existing structures.

This object is achieved in accordance with the invention by the fact that the sills or intermediate girders have webs extending into the beaded section and facing towards the road surface with sides disposed approximately parallel to each other, and that the sections of beading separated by the webs have concave recesses on their sides opposite the web of which the outer one, in each case, is engaged by the retainer body.

The increased width for the securing of the beadings in the sill and the decrease in thickness of the sill does not only guarantee a relatively rapid and simple installation for existing structures, for example for concrete roads divided by joints, but provides for a better securing to be effected in the sills than in the case of conventional fork-shaped sills.

The sills can be installed with their outer edges flush with the road surface and may have a base parallel with the road surface. The constructional depth of such types of sills can, for example, be as small as 5 cm. Despite this limited depth the area of contact and, therefore, the securing of the beading in the sills is assured by the increased width of the securing surface.

It is preferable that the beading sections are provided, in each case, with at least two cavities; the latter may be round and disposed one above the other. Due to such round cavities, which can normally extend longitudinally through the entire joint spanning construction, the ease of insertion of the sealing body is assured as the material thereof permits partial displacement in the cavities during the pressing action on fitting into a sill or intermediate girder.

On driving over a joint spanning construction in accordance with the invention, it is further guaranteed that the securing engagement at the edges of the beading is only loaded, in each case, on one side by a suction action, whilst at the other side it is compressed. The web of the sill or intermediate girder also distributes the load so that lifting-out of the beading is prevented, even though the top edge of the sill runs flush with the road surface and, consequently, with the top edge of the sealing body.

The thickness of the sills is preferably less than the height of the folded sealing body. With a joint closed, the sealing body is normally folded down and can provide a constructional thickness of 6–7 cm whilst the thickness of the sill, as already stated, can amount to only 5 cm for example.

Other features of the invention will be apparent from the following description, drawings and claims, the scope of the invention not being limited to the drawings themselves as the drawings are only for the purpose of illustrating ways in which the principles of the invention can be applied. Other embodiments of the invention utilising the same or equivalent principles may be used and structural changes may be made as desired by those skilled in the art without departing from the present invention and the purview of the appended claims.

DESCRIPTION OF THE PREFERRED EMBODIMENTS

Figure 1:
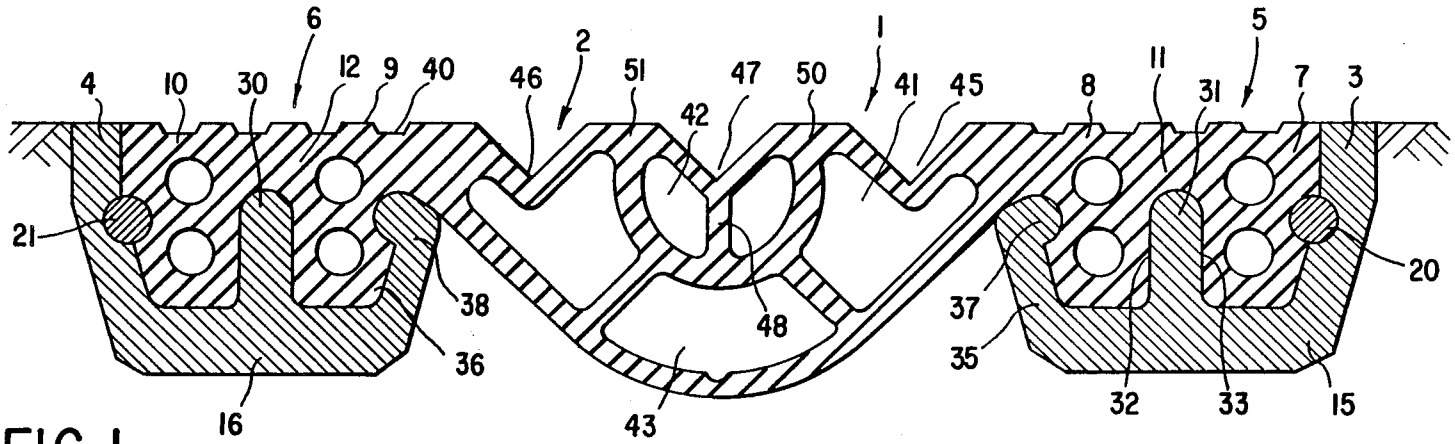
FIG. 1 shows a longitudinal section through a joint spanning construction in accordance with the invention, with the joint gap spanned drawn open.

Referring first to FIG. 1 of the drawings, a joint spanning construction 1 consists of a sealing body 2 and of sills 3 and 4.

The constructional thickness of the sills 3 and 4 amounts to 5 cm, the minimum distance between the external edges of the sills 3 and 4 for joints moved together being 19 cm, whilst the maximum distance for the joints moved apart amounts to 29 cm.

Beading 5 and 6 of the sealing body 2 has a constructional thickness of approximately 3.5 cm and is divided into equal sections 7 and 8, or 9 and 10, in the arrangement illustrated, which sections are interconnected by webs 11 or 12. The sills 3 and 4 have a flat base 15 or 16 and can therefore be placed upon a correspondingly prepared bed; it is, of course, also possible (as described in detail hereinafter) to increase the constructional thickness of the sills by additional components.

The almost equal sections 7 to 10 of the beading 5 and 6 are secured in each case with respect to the sills 3 or 4 by means of circular retainer bodies 20 or 21 on their outer sides and in concave recesses on their inner sides, the retainer bodies being retained half in the sills and half in the beading. These retainer bodies may consist of a particularly hard resilient rubber or like material or even be of metal.

The sills 3 and 4 have centre webs 30 and 31 directed towards the road surface, on either side of which the individual sections of beading are disposed. The centre webs 30 and 31 have parallel side walls 32 and 33 and a rounded free edge.

The edge 35 or 36 of each of the sills 3 and 4 overhanging towards the joint is provided with a semi-circular projection 37 and 38, which virtually acts in the same manner as the retainer bodies 20 and 21.

The beading sections in the arrangement illustrated have round through cavities 40 which are disposed one over the other in pairs in the beading sections and enable displacement of the material of the sealing body to take place during insertion thereof into the sills 3 and 4.

When the sealing body is to be inserted into the sills, the sections 8 or 9 facing the centre are initially pressed into the sills and then the two outer sections 7 or 10 together with the round retainer bodies 20 and 21 are pressed in.

The overhanging parts of the sills 37 and 38 work as a link of the centre section of the sealing body 2, which directly bridges the joint.

The centre section of the sealing body 2 has individual hollow voids 41, 42 and 43 which lie beneath niched sections 45 and 46, whilst the niched section 47 over a vertical web 48 divides the void 42. The web 47, however, lies above the void or chamber 43. This ensures that when the joint opens and closes the sections 50 and 51 always remain in the plane of the top edge of the road surface.

Figure 2:
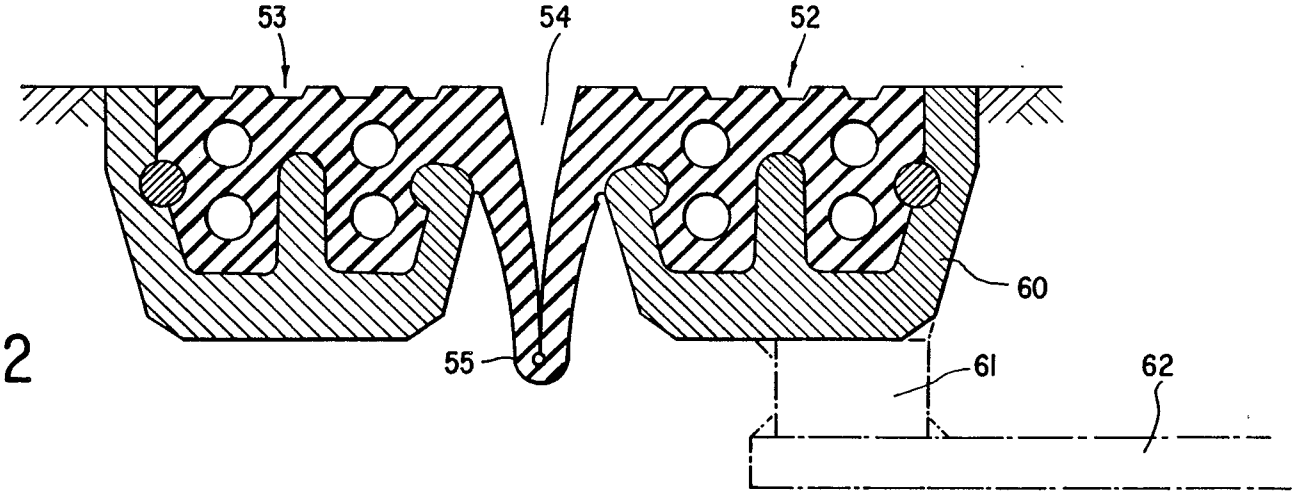
FIG. 2 shows a longitudinal section through a modified construction with the joint gap almost closed.

The same basic principle for the securing of the beading 52 and 53 has been applied in respect of the embodiment depicted in FIG. 2; even the sills have the same design for the same constructional thickness. The centre part of the sealing body 54, however, can only be folded once and can span 5 mm or be increased up to 75 mm. The joint spanning construction illustrated in FIG. 2 has accordingly a minimum distance, in respect of the distance between outer edges of the sills, which is 16.5 cm and a maximum distance of 23.5 cm. The folded edge 55 has a thickness of approximately 6 to 6.5 cm for joints moved together.

As indicated by chain-dotted lines in FIG. 2, the right hand sills 60 lie on a steel construction, whereby the difference in height relative to a plate-shaped steel body 62 is bridged by means of struts or block-shaped parts 61. This foundation can be considered necessary if the flat sills have a limited constructional thickness (e.g. 5 cm) leaving a space to be filled out at the edge of the structure.

I claim:

1. A joint spanning construction for bridges or similar structures with which sealing bodies, flush with the top surface of the road and made of resilient rubber material, are inserted by means of beading from above into recesses of sills or threshold pieces and, should the occasion arise, of movable intermediate girders, and secured against lifting out by retainer bodies which are basically of circular cross-section and fit partly in a wall of the sill recess and partly in the beading, wherein the sills or intermediate girders have a base substantially parallel with and beneath the road surface, and are provided with webs having sides extending upwardly substantially parallel to each other, directed towards the road surface and projecting into the beading, an outer of said webs having a concave recess facing a mirror-image concave recess in said sealing body, and an inner of said webs having a semicircular upwardly facing end, and the sealing body having sections separated by the webs, each section provided with concave recesses opposite to the web(s), the outer recess is engaged by the retainer body, and the inner recess is engaged by the inner web semicircular end.

2. A joint spanning construction according to claim 1, wherein the sills terminate with their outer edges flush with the road surface and are provided with a base substantially parallel with the road.

3. A joint spanning construction according to claim 1, wherein said sections of beading are provided in each case with at least two cavities.

4. A joint spanning construction according to claim 3, wherein said cavities are disposed one over the other and are of circular cross-section.

5. A joint spanning construction according to claim 1, wherein the constructional height of the sills is less than the height of the folded sealing body.

6. A joint spanning construction according to claim 1, wherein the beading in its effective position has surface contact with the sills throughout.

7. In combination, a joint spanning construction for road surfaces on bridges and the like, comprising a pair of sills adapted for laying adjacent to the joint, one sill on either side of the joint, at a position below the road surface, each sill having a cross-section with (a) a first upstanding web adjacent said joint, said web having an enlarged end facing away from said joint, (b) a second upstanding web farther from said joint than said first web, said second upstanding web extending flush with said road surface and having a concave recess facing toward said joint, and (c) a third upstanding web intermediate said first and second webs, said third upstanding web terminating beneath said road surface; a resilient sealing body adapted for spanning said joint, said sealing body having a top flush with said road and having respective downwardly depending edges shaped to conform to said sill webs, and further having an outer edge with a concave recess facing said second web concave recess; and (d) a retainer body of generally circular cross section adapted for insertion into the recess formed by the respective concave facing recesses of said second upstanding web and said sealing body outer edge.

* * * * *